US010525741B2

(12) United States Patent
Yamaguchi

(10) Patent No.: US 10,525,741 B2
(45) Date of Patent: Jan. 7, 2020

(54) DRIVING DEVICE, SHEET FEEDING DEVICE AND IMAGE FORMING APPARATUS INCLUDING SAME

(71) Applicant: KYOCERA Document Solutions Inc., Osaka (JP)

(72) Inventor: Akihiro Yamaguchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 150 days.

(21) Appl. No.: 15/912,022

(22) Filed: Mar. 5, 2018

(65) Prior Publication Data

US 2018/0264857 A1 Sep. 20, 2018

(30) Foreign Application Priority Data

Mar. 14, 2017 (JP) ..... 2017-048402

(51) Int. Cl.

| | |
|---|---|
| ***B41J 23/02*** | (2006.01) |
| ***B65H 3/06*** | (2006.01) |
| ***B65H 5/00*** | (2006.01) |
| ***G03G 21/16*** | (2006.01) |
| ***B41J 11/14*** | (2006.01) |
| ***G03G 15/00*** | (2006.01) |
| ***B41J 11/04*** | (2006.01) |

(52) U.S. Cl.
CPC ..... *B41J 11/14* (2013.01); *B41J 11/04* (2013.01); *G03G 15/757* (2013.01)

(58) Field of Classification Search
CPC .... B41J 13/0009; B41J 13/0018; B41J 23/02; B41J 23/025; B41J 11/04; B41J 11/14; B65H 3/06; B65H 3/0669; B65H 3/0684; B65H 5/00; B65H 2403/422; B65H 2403/5331; G03G 15/757; G03G 15/00; G03G 21/16
USPC ..... 271/270; 399/167, 391, 392, 396; 400/624, 636, 636.2, 641
See application file for complete search history.

(56) References Cited

U.S. PATENT DOCUMENTS 7,277,663 B2 * 10/2007 Kimijima ..... B65H 29/12 399/167
2007/0053719 A1 3/2007 Kamimura et al. ..... 399/167

FOREIGN PATENT DOCUMENTS

JP 2007-72021 A 3/2007
JP 2012-200929 A 10/2012

* cited by examiner

*Primary Examiner* — Leslie J Evanisko
(74) *Attorney, Agent, or Firm* — Stein IP, LLC

(57) ABSTRACT

A driving device includes a motor, a drive gear, a swing gear, a first gear member, a second gear member, a frame, and a bracket. The swing gear can swing between a first position engaging with the first gear member and a second position engaging with the second gear member. The bracket has a slide hole including a pair of contact parts having an arc shape, and an arc hole part for connecting the pair of contact parts with a first sliding surface farther from the drive gear and a second sliding surface nearer to the drive gear. The first sliding surface has a shape retracting to the opposite side to the rotation shaft from tangential lines of the rotation shaft contacting with the contact parts, which are parallel to pressure angle directions between the drive gear and the swing gear, or a shape coinciding with the tangential lines.

8 Claims, 9 Drawing Sheets

DRIVING DEVICE, SHEET FEEDING DEVICE AND IMAGE FORMING APPARATUS INCLUDING SAME

INCORPORATION BY REFERENCE

This application is based upon and claims the benefit of priority from the corresponding Japanese Patent Application No. 2017-048402 filed Mar. 14, 2017, the entire contents of which are hereby incorporated by reference.

BACKGROUND

The present disclosure relates to a driving device used in a copier, a printer, a facsimile, a multifunction peripheral of them, or the like, and a sheet feeding device and an image forming apparatus including the driving device.

Conventionally, a color image forming apparatus is configured to be capable of switching between monocolor (monochrome) image formation using black color and multicolor (color) image formation. The monocolor image formation and the multicolor image formation have different image formation processing speeds, and a mechanism for switching between the monocolor image formation and the multicolor image formation is provided. With this switching mechanism, a structure of the image forming apparatus is unnecessarily complicated, and cost of the image forming apparatus is increased.

Therefore, an image forming apparatus is known, which includes a driving device for driving an image forming unit that stores black color developer to be used both for the monocolor image formation and for the multicolor image formation. When forming a monochrome image, a motor is driven to rotate in a first direction, a drive gear rotates in the first direction, and a swing gear moves to a first position so as to be engaged with a first gear train. A black gear positioned at an end of the first gear train drives a black color image forming unit to rotate at a first rotation speed. On the other hand, when forming a color image, the motor is driven to rotate in a second direction, the drive gear rotates in the second direction, the swing gear moves to a second position so as to be engaged with a second gear train having a different reduction ratio from the first gear train. A black gear positioned at an end of the second gear train drives the black color image forming unit to rotate at a second rotation speed. In this way, only by changing the rotation direction of the single motor, monochrome image formation operation and color image formation operation can be switched.

In addition, a driving device is known, which includes a drive gear disposed to be capable of rotating in a first direction and in a second direction according to a rotation direction of a motor, and a swing gear configured to be engaged with the drive gear and to be capable of swing between a first position and a second position according to a rotation direction of the motor by a rotation drive force transmitted to the drive gear. In this driving device, a bracket having a slide hole for holding the swing gear in a rotatable and swingable manner is configured to have a larger stiffness than the swing gear and a smaller friction coefficient than the frame. In this way, when a rotation shaft of the swing gear rotates and swings repeatedly in the slide hole, sliding performance of the rotation shaft of the swing gear is not decreased, and fluctuation in a rotation torque or a rotation speed in a drive output part can be suppressed.

SUMMARY

A driving device according to one aspect of the present disclosure includes a motor, a drive gear, a swing gear, a first gear member, a second gear member, a frame, and a bracket. The motor generates a rotation drive force. A drive gear can rotate in a first direction and in a second direction according to forward and reverse rotations of the motor. The swing gear is disposed to engage with the drive gear and can swing between a first position and a second position by a rotation drive force transmitted from the drive gear. The first gear member engages with the swing gear when the drive gear rotates in the first direction so that the swing gear swings to the first position. The second gear member engages with the swing gear when the drive gear rotates in the second direction so that the swing gear swings to the second position. The frame holds the first gear member and the second gear member in a rotatable manner. The bracket has a slide hole for holding a rotation shaft of the swing gear in a slidable and rotatable manner so as to guide the swing gear to the first position and to the second position, and is attached to the frame. The slide hole includes a pair of contact parts having an arc shape with which the rotation shaft contacts when the swing gear is positioned at the first position and at the second position, and an arc hole part for connecting the pair of contact parts with a first sliding surface farther from the drive gear and a second sliding surface nearer to the drive gear. The first sliding surface has a shape retracting to the opposite side to the rotation shaft from tangential lines of the rotation shaft contacting with the contact parts, which are parallel to pressure angle directions between the drive gear and the swing gear, or a shape coinciding with the tangential lines.

Other objects of the present disclosure and specific advantages obtained by the present disclosure will become more apparent from the description of embodiments given below.

DETAILED DESCRIPTION

Figure 1:
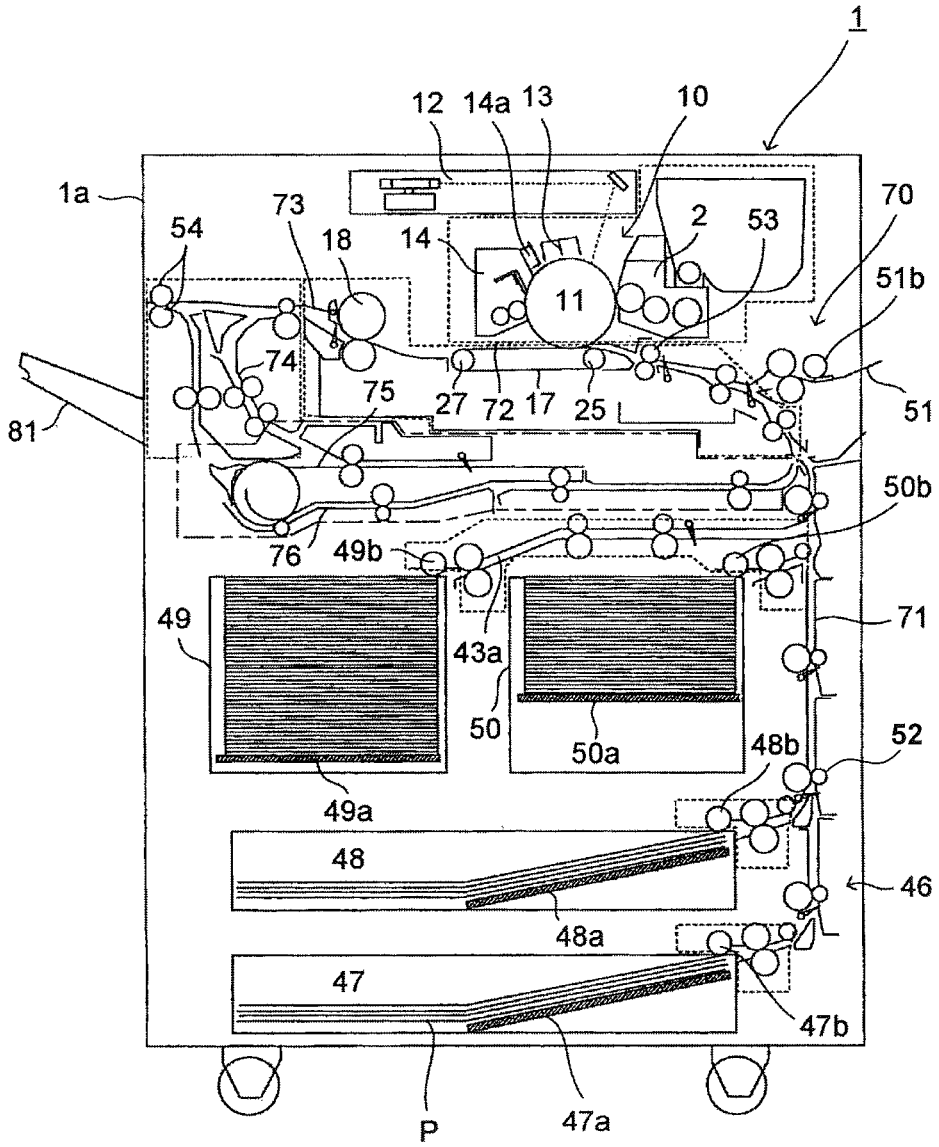
FIG. 1 is a diagram schematically showing an image forming apparatus including a driving device according to the present disclosure.

Hereinafter, embodiments of the present disclosure are described with reference to the drawings. FIG. 1 is a diagram schematically showing an overall structure of an image forming apparatus of the present disclosure. The image forming apparatus 1 includes an apparatus main body 1*a* having a rectangular solid shape, and an image forming unit 10 is disposed in an upper part of the apparatus main body 1*a*. The image forming unit 10 includes a photosensitive drum 11, an electrification device 13, an exposing unit 12, a developing device 2, a cleaning device 14, and a charge elimination device 14*a*.

The photosensitive drum 11 is supported by the apparatus main body la in a rotatable manner, and a photosensitive layer is formed on a surface of the photosensitive drum 11. As a photosensitive material forming the photosensitive layer, amorphous silicon or an organic photosensitive layer (OPC) is used. The developing device 2 is disposed so as to face the photosensitive drum 11 on the right side thereof, and supplies toner to the photosensitive drum 11. The electrification device 13 is disposed to face the surface of the photosensitive drum 11 on an upstream side of the developing device 2 in a rotation direction of the photosensitive drum 11, and uniformly electrifies the surface of the photosensitive drum 11.

The exposing unit 12 irradiates the surface of the photosensitive drum 11 with laser light based on read image data from a downstream side of the electrification device 13 in the rotation direction of the photosensitive drum 11. The laser light forms an electrostatic latent image on the surface of the photosensitive drum 11, and this electrostatic latent image is developed into a toner image by the developing device 2.

A transfer conveyor belt 17 is stretched around a transfer roller 25 and a driven roller 27, and the transfer roller 25 is disposed to face the photosensitive drum 11 via the transfer conveyor belt 17. The toner image formed on the surface of the photosensitive drum 11 is transferred onto a paper sheet P conveyed on the transfer conveyor belt 17, by the transfer roller 25 applied with a transfer bias. After the toner image is transferred, toner remaining on the surface of the photosensitive drum 11 is removed by the cleaning device 14. In addition, charge remaining on the surface of the photosensitive drum 11 is eliminated by the charge elimination device 14*a*.

A sheet feeding part 46 is constituted of sheet feed cassettes 47 and 48, large capacity decks 49 and 50, and a manual feed tray 51, and the like. The sheet feed cassettes 47 and 48 are arranged in parallel in a vertical direction in a bottom part of the apparatus main body 1*a*, and the paper sheets P are placed on placing plates 47*a* and 48*a* of the sheet feed cassettes 47 and 48. Above the sheet feed cassette 48, the large capacity decks 49 and 50 are arranged in parallel in a left/right direction, and the paper sheets P are placed on placing plates 49*a* and 50*a* of the large capacity decks 49 and 50. Upper right parts of the sheet feed cassettes 47 and 48 and the large capacity decks 49 and 50 are provided with pickup rollers 47*b* to 50*b*, respectively, which send out the paper sheets P on the placing plates 47*a* to 50*a*, respectively, one by one to the sheet conveying path. Further, the manual feed tray 51 is disposed on the right side of the apparatus main body 1*a*, and the manual feed tray 51 is also provided with a pickup roller 51*b*. Further, a registration roller pair 53 is disposed on the right side of the transfer roller 25, so as to control timing for conveying the paper sheet P to the image forming unit 10.

A sheet conveying part 70 conveys the paper sheet P inside the apparatus main body 1*a*. The sheet conveying part 70 includes a sheet feed conveying path 71, an image formation conveying path 72, a discharge conveying path 73, a branch conveying path 74, a reverse conveying path 75, and a reconveying path 76.

The paper sheet P supplied from the sheet feeding part 46 is conveyed upward in the sheet feed conveying path 71 and further conveyed to the transfer roller 25 after the conveyance timing is adjusted by the registration roller pair 53. Then, the toner image is transferred onto the paper sheet P by the transfer roller 25. The paper sheet P with the transferred toner image passes through the image formation conveying path 72 and is conveyed to a fixing unit 18. The paper sheet P is heated and pressed in the fixing unit 18 so that the toner image is melted and fixed to the paper sheet P. The paper sheet P with the fixed toner image passes through the discharge conveying path 73 and is discharged onto a discharge tray 81 by a discharge roller 54.

When performing double-side printing, the paper sheet P after fixing in the fixing unit 18 is conveyed to the branch conveying path 74 so that front and back sides of the paper sheet P is reversed by the reverse conveying path 75. The reversed paper sheet P is conveyed to the sheet feed conveying path 71 again via the reconveying path 76. In the image forming unit 10, a toner image is transferred onto the back side of the paper sheet P conveyed to the sheet feed conveying path 71. After the toner image is melted and fixed in the fixing unit 18, the paper sheet P is discharged onto the discharge tray 81.

Figure 2:
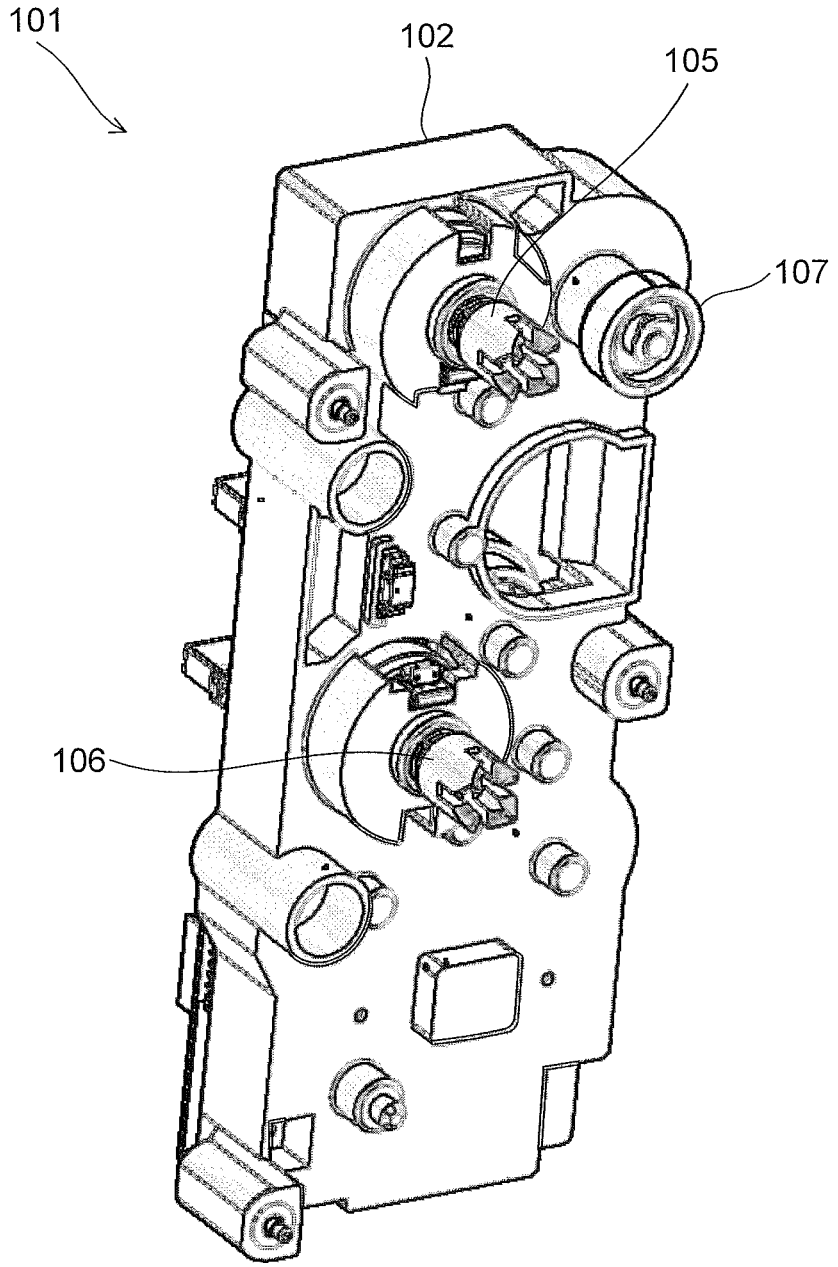
FIG. 2 is an external perspective view of the driving device according to a first embodiment of the present disclosure, viewed from the front side.
Figure 3:
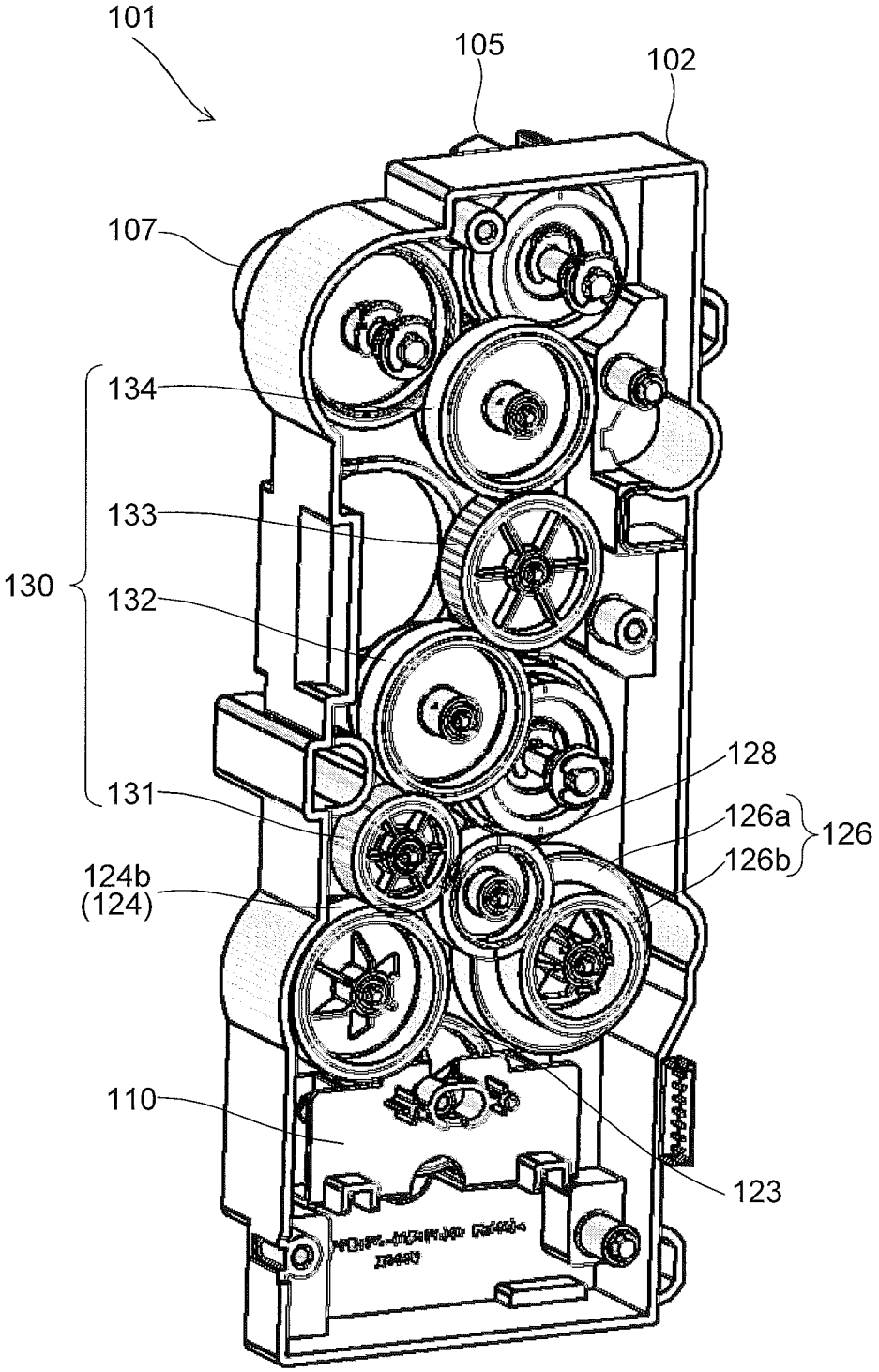
FIG. 3 is an external perspective view of an internal structure of the driving device of the first embodiment, viewed from the rear side.
Figure 4:
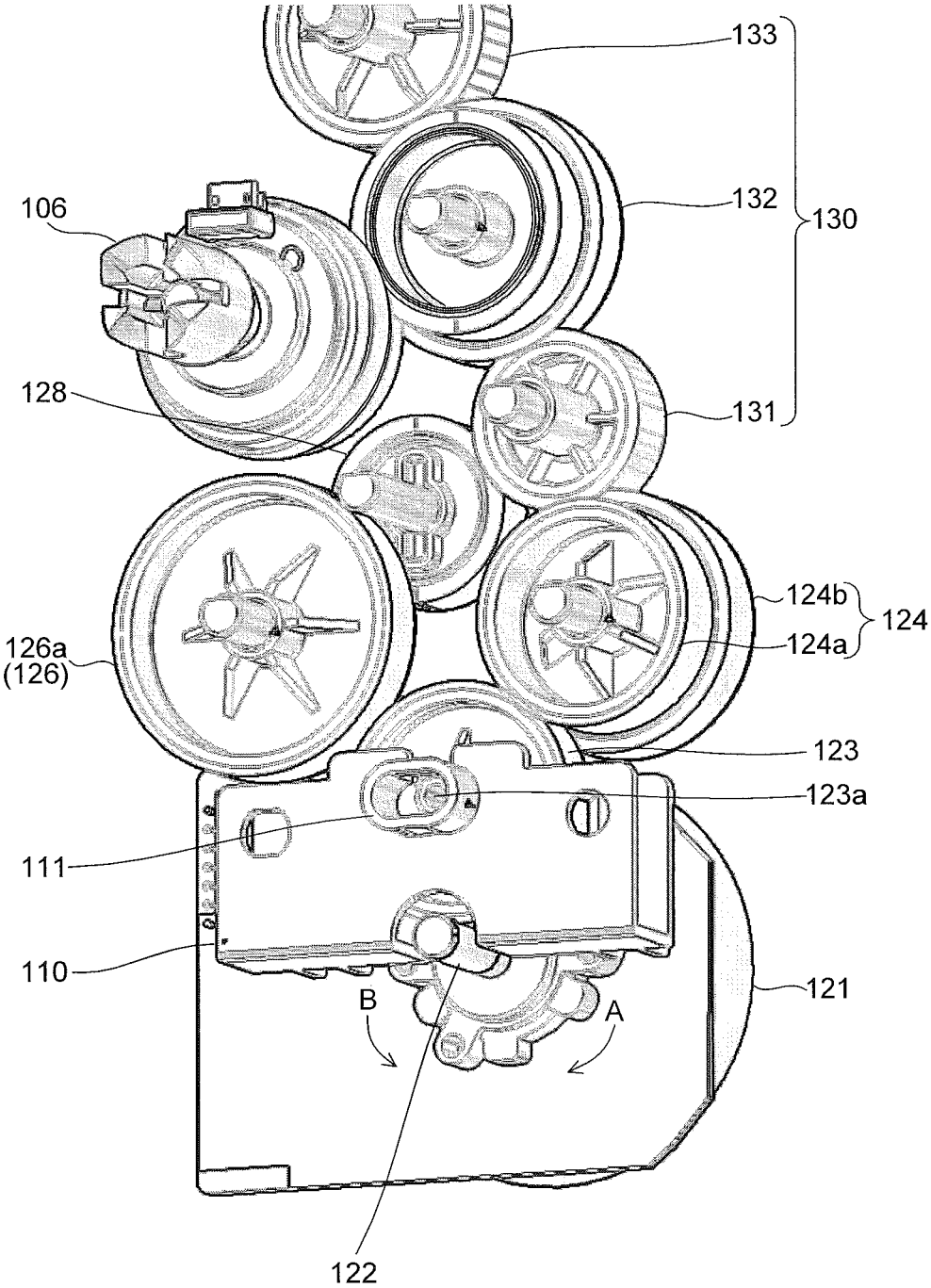
FIG. 4 is an external perspective view of gears in a main part of the driving device of the first embodiment, viewed from the front side.

The pickup rollers 47*b* and 48*b* of the sheet feed cassettes 47 and 48 are driven to rotate by a driving device 101 shown in FIGS. 2 to 4. FIG. 2 is an external perspective view of the driving device 101 according to a first embodiment of the present disclosure, viewed from the side of the pickup rollers 47*b* and 48*b* (front side). FIG. 3 is a perspective view of an internal structure of the driving device 101 of the first embodiment viewed from the rear side. FIG. 4 is a perspective view of gears in a main part of the driving device 101 of the first embodiment viewed from the front side.

As shown in FIG. 2, the driving device 101 includes a first coupling 105, a second coupling 106, and a third coupling 107. The first to third couplings 105 to 107 as drive output parts are disposed to protrude from an outer peripheral surface of a frame 102 having a rectangular solid shape. The first coupling 105 is supported by an upper part of the frame 102 in a rotatable manner and is coupled to the pickup roller 48*b* (see FIG. 1) so as to rotate the pickup roller 48*b*. The second coupling 106 is supported by a lower part of the frame 102 in a rotatable manner and is coupled to the pickup roller 47*b* (see FIG. 1) so as to rotate the pickup roller 47*b*. The third coupling 107 is supported by the frame 102 on the right side of the first coupling 105 in a rotatable manner and is coupled to a convey roller 52 (see FIG. 1) of the sheet feed conveying path 71 so as to rotate the convey roller 52.

As shown in FIG. 3, the driving device 101 includes a box-like frame 102 opening on one side, a flat plate frame (not shown) having a flat plate shape facing the open side of the frame 102, and a bracket 110 that supports a swing gear 123 in a swingable manner. The bracket 110 is fixed and held by the frame 102.

In addition, the driving device 101 includes a motor 121 (see FIG. 4), a drive gear 122 (see FIG. 4), the swing gear 123, a first gear member 124, a second gear member 126, an idle gear 128, and a gear train 130. The drive gear 122, the first gear member 124, the second gear member 126, the idle gear 128, and the gear train 130 are held in a rotatable manner by bearing members provided to the frame 102 and the not shown flat plate frame.

The motor 121 is constituted of a DC brushless motor that can rotate forward and backward, and is fixed and held in a lower part inside the frame 102. By changing a voltage applied to the motor 121, the motor 121 can change the rotation speed within the range of substantially three times a predetermined rotation speed. Note that the motor 121 may be a stepping motor.

The drive gear 122 constituted of a spur gear (see FIG. 4) is fixed to a rotation shaft of the motor 121. The drive gear 122 is engaged with the swing gear 123 constituted of a spur gear. Note that the drive gear 122 is not limited to gear fixed directly to the motor 121 but may be a gear engaged with a gear fixed to the rotation shaft of the motor 121. In addition, a helical gear may be used as the drive gear 122. In this way, it is possible to reduce noise and vibration.

When the motor 121 is driven to rotate, its rotation drive force is transmitted from the drive gear 122 to the first to third couplings 105 to 107 via the swing gear 123, the first gear member 124, and the gear train 130. Alternatively, the rotation drive force is transmitted from the drive gear 122 to the first to third couplings 105 to 107 via the swing gear 123, the second gear member 126, the idle gear 128, and the gear train 130.

As shown in FIG. 4, a rotation shaft 123*a* of the swing gear 123 is held in a swingable manner in a slide hole 111 having a long hole shape formed in the bracket 110. The slide hole 111 is formed in substantially an arc of a circle concentric with a pitch circle of the drive gear 122. In this way, the swing gear 123 maintains engagement with the drive gear 122 while the rotation shaft 123*a* easily swings in the slide hole 111. The swing gear 123 is disposed to be capable of moving between a first position in which the rotation shaft 123*a* contacts with a right side end surface in the slide hole 111 shown in FIG. 4 and a second position in which the rotation shaft 123*a* contacts with a left side end surface in the slide hole 111.

When the motor 121 is driven to rotate, the drive gear 122 rotates in a first direction (in an A direction shown in FIG. 4), and the rotation drive force of the drive gear 122 is transmitted to the swing gear 123. The rotation drive force causes the rotation shaft 123*a* to move to the right in the slide hole 111, so that the swing gear 123 reaches the first position.

On the other hand, when the motor 121 is driven to rotate in the reverse direction, the drive gear 122 rotates in a second direction (in a B direction shown in FIG. 4), and the rotation drive force of the drive gear 122 is transmitted to the swing gear 123. The rotation drive force causes the rotation shaft 123*a* to move to the left in the slide hole 111, and the swing gear 123 reaches the second position.

When the swing gear 123 moves to the first position (when the rotation shaft 123*a* is positioned at the right side end surface in the slide hole 111 shown in FIG. 4), the swing gear 123 is engaged with the first gear member 124. On the other hand, when the swing gear 123 moves to the second position (when the rotation shaft 123*a* is positioned at the left side end surface in the slide hole 111 shown in FIG. 4), the swing gear 123 is engaged with the second gear member 126.

The first gear member 124 is constituted of a first input gear 124*a* and a first output gear 124*b*. The first input gear 124*a* and the first output gear 124*b* are disposed integrally on the same shaft, and each of them is constituted of a spur gear.

With reference to FIG. 3 again, the second gear member 126 is constituted of a second input gear 126*a* and a second output gear 126*b*. The second input gear 126*a* and the second output gear 126*b* are disposed integrally on the same shaft, and each of them is constituted of a spur gear. The numbers of teeth of the second input gear 126*a* and the second output gear 126*b* are set so that a reduction ratio the second gear member 126 is different from that of the first gear member 124. The second output gear 126*b* is engaged with the idle gear 128 constituted of a spur gear.

The idle gear 128 and the first output gear 124*b* of the first gear member 124 are both engaged with the gear train 130. The gear train 130 includes a front gear 131, a first intermediate gear 132, a second intermediate gear 133, and a terminal gear 134 in the transmission order of the rotation drive force. Each of the gears 131 to 134 is constituted of a spur gear and is engaged with a neighboring gear.

The front gear 131 is engaged with the first output gear 124*b* of the first gear member 124 and is engaged with the idle gear 128. The terminal gear 134 is engaged with a gear provided to the first coupling 105, so that the rotation drive force of the drive gear 122 is transmitted to the first coupling 105 via the gear train 130. In addition, the terminal gear 134 is engaged with a gear provided to the third coupling 107, so that the rotation drive force of the drive gear 122 is transmitted to the third coupling 107 via the gear train 130. Further, the first intermediate gear 132 of the gear train 130 is engaged with a gear provided to the second coupling 106 (see FIG. 2), so that the rotation drive force of the drive gear 122 is transmitted to the second coupling 106 via a part of the gear train 130.

When the motor 121 is driven to rotate in the forward direction, the drive gear 122 rotates in the first direction (in the A direction shown in FIG. 4), and the rotation drive force of the drive gear 122 is transmitted to the swing gear 123. The rotation drive force causes the swing gear 123 to move to the first position (right end position shown in FIG. 4). In the first position, the swing gear 123 is engaged with the first gear member 124, so that the rotation drive force is transmitted to the gear train 130 via the first gear member 124, and hence each of the first to third couplings 105 to 107 engaged with the gear train 130 rotates at a predetermined rotation speed.

The first coupling 105 and the third coupling 107 receive the rotation drive force via the gear train 130, while the second coupling 106 receives the rotation drive force via a part of the gear train 130 (the front gear 131 and the first intermediate gear 132). In this way, the first and third couplings 105 and 107 rotate at a rotation speed different from that of the second coupling 106. Further, by setting different number of teeth between gears of the first and third couplings 105 and 107, the first coupling 105 and the third coupling 107 can have different rotation speeds. Therefore, the first and second couplings 105 and 106 can rotate the pickup rollers 47*b* and 48*b* of the sheet feed cassettes 47 and 48 (see FIG. 1) at different rotation speeds. Further, the third coupling 107 can rotate the convey roller 52 of the sheet feed conveying path 71 (see FIG. 1) at a predetermined rotation speed.

When the motor 121 is driven to rotate in the reverse direction, the drive gear 122 rotates in the second direction (the B direction in FIG. 4), and the rotation drive force of the drive gear 122 is transmitted to the swing gear 123. The rotation drive force causes the swing gear 123 to move to the second position (left end position in FIG. 4). In the second position, the swing gear 123 is engaged with the second gear member 126, and the rotation drive force is transmitted to the gear train 130 via the second gear member 126 and the idle gear 128. Because the idle gear 128 is engaged with the second gear member 126 and the gear train 130, when the drive gear 122 rotates in the second direction, the gear train 130 rotates in the same direction as when the drive gear 122 rotates in the first direction. When the gear train 130 rotates, the first to third couplings 105 to 107 engaged with the gear train 130 rotate at predetermined rotation speeds. When the drive gear 122 rotates in the second direction, each of the first to third couplings 105 to 107 rotates at a rotation speed different from that when the drive gear 122 rotates in the first direction, in accordance with a difference between reduction ratios of the first gear member 124 and the second gear member 126.

With the structure the driving device 101 as described above, by switching the rotation direction of the motor 121, the rotation speeds of the first to third couplings 105 to 107 can be easily switched.

The image forming apparatus 1 has variety of types according to printing speed and a print paper sheet size. In other words, the image forming apparatus 1 has variety of types of printing speed from high speed to low speed, and hence it is necessary to switch the rotation speeds of the pickup roller of the sheet feed cassette and the convey roller according to the printing speed. In addition, the image forming apparatus 1 has variety of types of paper sheet sizes. Because the printing speed is different depending on the paper sheet size, it is necessary to switch the rotation speeds of the pickup roller and the convey roller according to the paper sheet size.

Therefore, in order to support various rotation speeds of the pickup roller and the convey roller of the image forming apparatus 1, the driving device 101 of this embodiment is incorporated near the sheet feed cassettes 48 and 49. In accordance with the printing speed and the paper sheet size of the image forming apparatus 1, first the motor 121 of the driving device 101 is switched within a range of substantially three times a predetermined rotation speed, and further the rotation direction of the motor 121 is switched. In this way, a switching range of the rotation speed is widened, and it is not necessary to prepare driving devices for various image forming apparatuses 1. By preparing only one driving device 101, it is possible to support multiple types of the image forming apparatuses 1 described above.

Figure 5:
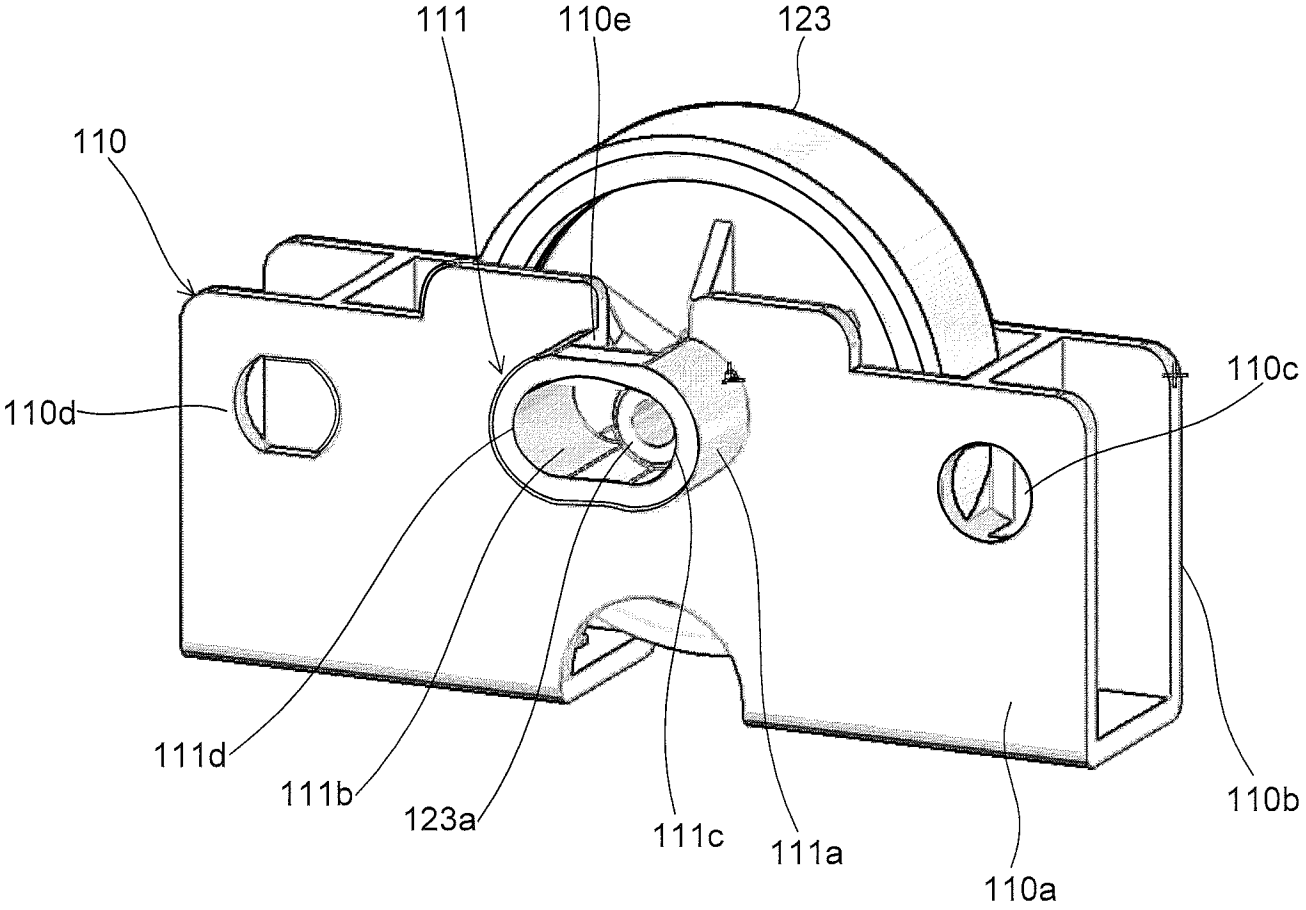
FIG. 5 is an external perspective view of a bracket holding a swing gear of the driving device of the first embodiment.
Figure 6:
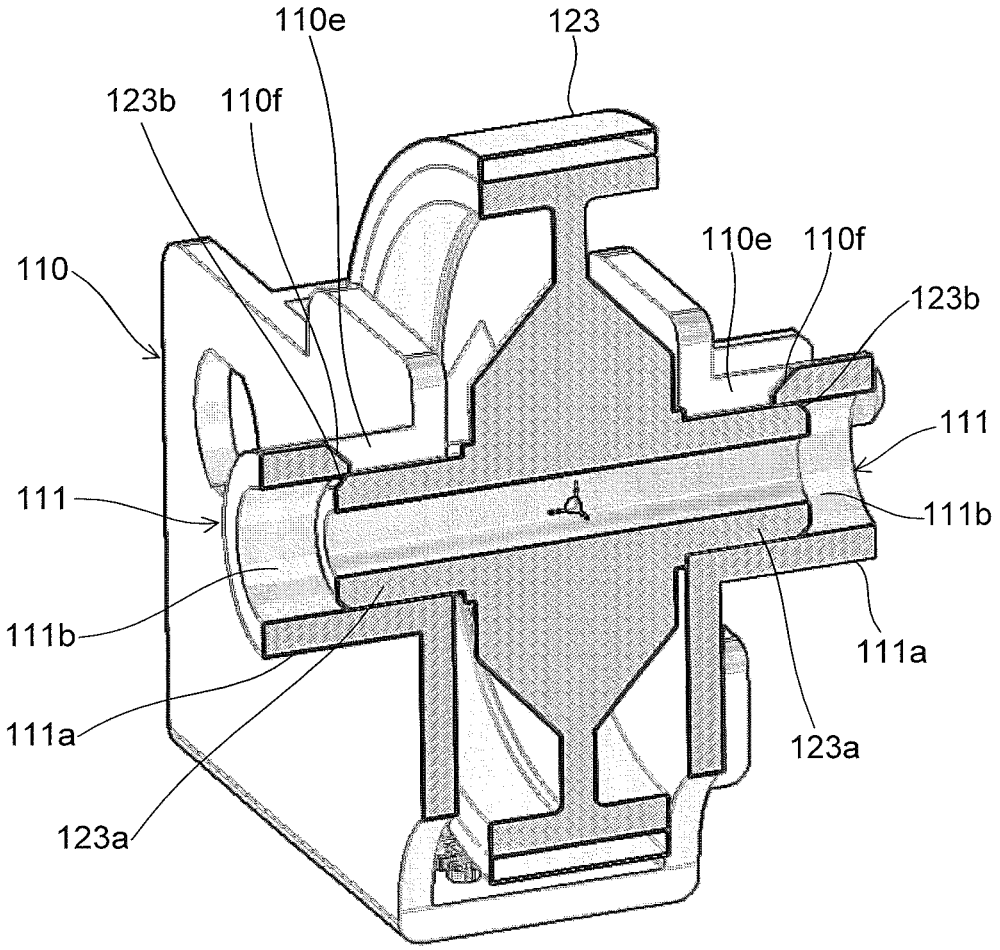
FIG. 6 is a cross-sectional perspective view of the swing gear and the bracket of the driving device of the first embodiment.

FIGS. 5 and 6 are diagrams showing the bracket 110 for holding the swing gear 123 that is used in the driving device 101 of the first embodiment. FIG. 5 is a perspective view of the bracket 110 viewed from the front side, and FIG. 6 is a cross-sectional perspective view of a connection part between the swing gear 123 and the bracket 110.

As shown in FIG. 5, the bracket 110 has the slide hole 111 described above, side base parts 110*a* and 110*b*, mounting holes 110*c* and 110*d*, and a pair of built-in holes 110*e* (see FIG. 6).

The side base parts 110*a* and 110*b* are formed to face each other, and lower sides thereof are connected to each other. In addition, the upper side of the bracket 110 is opened so that the swing gear 123 having a protruding part can be housed.

The mounting holes 110*c* and 110*d* are formed on the left and right sides of the side base part 110*a*. The mounting holes 110*c* and 110*d* are engaged with a pair of protrusions provided to the frame 102 (see FIG. 3), and thus the bracket 110 is fixed to the frame 102.

A slide hole 111 is formed on the middle upper side of each of the side base parts 110*a* and 110*b*. Each slide hole 111 includes a flange part 111*a* protruding outward from the side base part 110*a* or 110*b*, an arc hole part 111*b* penetrating in the flange part 111*a*, and semicircular contact parts 111*c* and 111*d* provided to both ends of the arc hole part 111*b*. Each arc hole part 111*b* is formed so that the rotation shaft 123*a* of the swing gear 123 can move between the contact parts 111*c* and 111*d*. The rotation shaft 123*a* of the swing gear 123 can move in the arc hole part 111*b* and can rotate in a state contacting with either one of the contact parts 111*c* and 111*d*. A detailed shape of the slide hole 111 will be described later.

The bracket 110 is formed to have the predetermined shape described above using polybutylene terephthalate (PBT) resin, and the swing gear 123 is made of polyacetal resin. Therefore, the bracket 110 has a larger stiffness than the swing gear 123, and when the rotation shaft 123*a* of the swing gear 123 rotates in contact with one of the end surfaces of the slide hole 111 of the bracket 110 for a long period or slides repeatedly in the arc hole part 111*b* of the slide hole 111, abrasion of the rotation shaft 123*a* of the swing gear 123 or the end surfaces of the slide hole 111 is suppressed. In addition, the frame 102 is made of polyphenyleneether (PPE) resin containing glass filler, and has strength for holding the motor 121 and the plurality of gears. On the other hand, the bracket 110 has a smaller friction coefficient and better sliding performance than the frame 102, there is no possibility that the rotation shaft 123*a* of the swing gear 123 is worn out.

Therefore, despite that the rotation shaft 123*a* of the swing gear 123 rotates and swings repeatedly in the slide hole 111, sliding performance of the rotation shaft 123*a* is not deteriorated, and variations in rotation torques or rotation speeds of the first to third couplings 105 to 107 are suppressed.

As shown in FIG. 6, the side base parts 110*a* and 110*b* and the flange parts 111*a* of the bracket 110 are respectively provided with the built-in holes 110*e* formed in the upper parts thereof. The built-in holes 110*e* are used for incorporating the swing gear 123 into the bracket 110. The pair of built-in holes 110*e* is formed to be a little smaller in an axis direction of the rotation shaft 123*a* of the swing gear 123 than the length of the rotation shaft 123*a* and to be a little larger in a radial direction of the rotation shaft 123*a* than the outer diameter of the rotation shaft 123*a*. End surfaces of the pair of built-in holes 110*e* in the axis direction have inclined surfaces 110*f*, and end surfaces of the rotation shaft 123*a* of the swing gear 123 are provided with chamfered parts 123*b*. In this way, it is easy to insert the rotation shaft 123*a* of the swing gear 123 into the pair of built-in holes 110*e*.

When assembling the swing gear 123 into the bracket 110, the rotation shaft 123*a* of the swing gear 123 is opposed to the built-in hole 110*e* of the bracket 110 and is pushed against the same. Then the built-in hole 110*e* of the bracket 110 is elastically deformed and enlarged in the axis direction of the rotation shaft 123*a*. The rotation shaft 123*a* of the swing gear 123 is guided by the inclined surface 110*f* and the chamfered part 123*b*, and hence is inserted into the built-in holes 110*e* of the bracket 110. When the rotation shaft 123*a* of the swing gear 123 is inserted into the built-in holes 110*e* of the bracket 110, the enlarged built-in holes 110*e* are restored, and the rotation shaft 123*a* of the swing gear 123 is fit in the slide hole 111 of the bracket 110.

Figure 7:
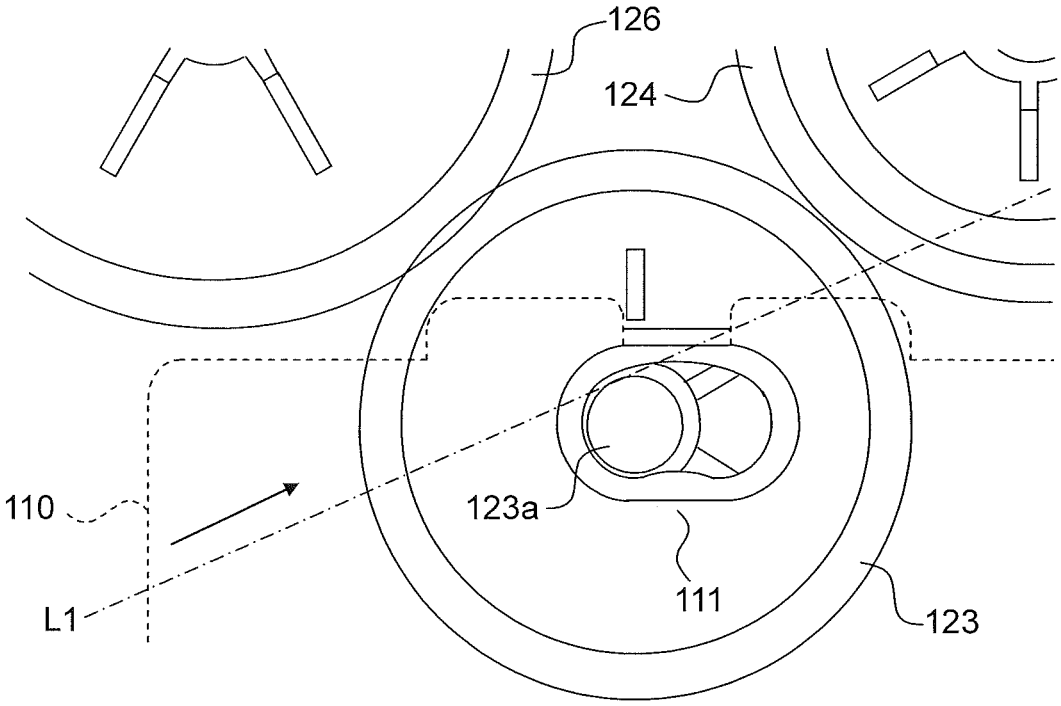
FIG. 7 is a side view of the swing gear and its vicinity of the driving device of the first embodiment, viewed from the front side.
Figure 8:
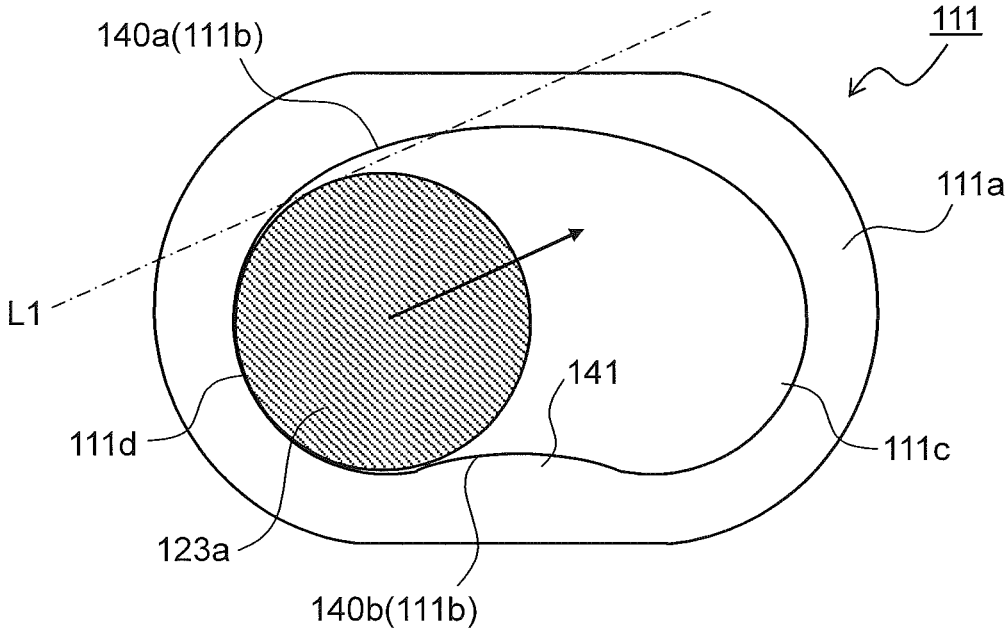
FIG. 8 is an enlarged partial view of a slide hole shown in FIG. 7 and is a diagram showing a state where the swing gear is positioned at a second position.
Figure 9:
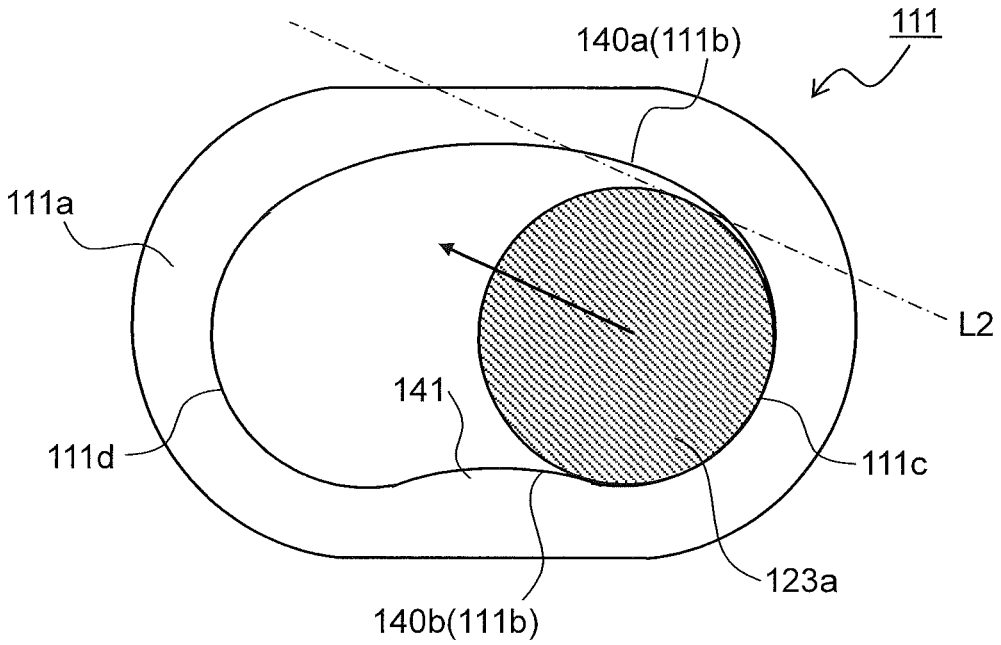
FIG. 9 is an enlarged partial view of the slide hole shown in FIG. 7 and is a diagram showing a state where the swing gear is positioned at a first position.

FIG. 7 is a side view of the swing gear 123 and its vicinity of the driving device 101 of the first embodiment, viewed from the front side. FIGS. 8 and 9 are enlarged partial views of the slide hole 111 in FIG. 7 and indicate states where the swing gear 123 is positioned at the second position and at the first position, respectively. With reference to FIGS. 7 to 9, a shape of the slide hole 111 in the driving device 101 of this embodiment is described in detail.

When moving the swing gear 123 by switching the rotation direction of the drive gear 122 (see FIG. 4), the swing gear 123 receives the rotation drive force as well as a pressing force in a pressure angle direction from the drive gear 122. The pressure angle is an angle between a radial line and a tangential line of the tooth at one point (pitch point) on the tooth surface, and the pressure angle is set to 20° in order that the gears are correctly engaged.

In this embodiment, the drive gear 122 and the swing gear 123 are engaged in the up/down direction (vertical direction), and hence the radial line is horizontal. In other words, the pressure angle direction is a direction inclined from the horizontal direction by 20°, and an action line of the pressing force acting on the swing gear 123 by the pressure angle is shown by a straight line L1 in FIG. 7. Note that the straight line L1 is a tangential line of the rotation shaft 123*a* of the swing gear 123 positioned at the second position.

On the other hand, when the rotation shaft 123*a* of the swing gear 123 positioned at the first position shown in FIG. 9 is moved to the second position shown in FIG. 8, because the rotation direction of the drive gear 122 is the reverse direction, the pressure angle direction is also the reverse direction. Specifically, as shown in FIG. 9, it is a straight line L2 obtained by horizontally flipping the straight line L1 of FIG. 8. Note that the straight line L2 is a tangential line of the rotation shaft 123*a* of the swing gear 123 positioned at the first position.

When the rotation shaft 123*a* of the swing gear 123 positioned at the second position shown in FIG. 8 is moved to the first position shown in FIG. 9, the pressing force in the pressure angle direction (an arrow direction in FIG. 8) acts on the swing gear 123. In addition, when the rotation shaft 123*a* of the swing gear 123 positioned at the first position shown in FIG. 9 is moved to the second position shown in FIG. 8, the pressing force in the pressure angle direction (an arrow direction in FIG. 9) acts on the swing gear 123.

Therefore, in this embodiment, a first sliding surface 140*a* that is farther from the drive gear 122 in the arc hole part 111*b* connecting the contact parts 111*c* and 111*d* of the slide hole 111 is shaped to retract to the opposite side to the rotation shaft 123*a* from the straight lines L1 and L2 (in the upward direction in FIGS. 8 and 9).

With this structure, when rotating the drive gear 122 in the A direction in FIG. 4 so as to move the swing gear 123 to the first position, or when rotating the drive gear 122 in the B direction in FIG. 4 so as to move the swing gear 123 to the second position, there is no possibility that the movement of the rotation shaft 123*a* in the slide hole 111 is prevented by the first sliding surface 140*a*. Therefore, the rotation shaft 123*a* of the swing gear 123 can be smoothly moved in a reciprocating manner along the slide hole 111, and hence a switching error of the drive train and abrasion of the rotation shaft 123*a* or the first sliding surface 140*a* can be effectively suppressed.

In addition, a convex shape 141 is formed toward the inside of the slide hole 111 from a second sliding surface 140*b* that is nearer to the drive gear 122 in the arc hole part 111*b*. In this way, in a state where the rotation of the motor 121 is stopped, movement of the rotation shaft 123*a* in the slide hole 111 is restricted, and hence the swing gear 123 can be stably held at the first position or the second position.

Figure 10:
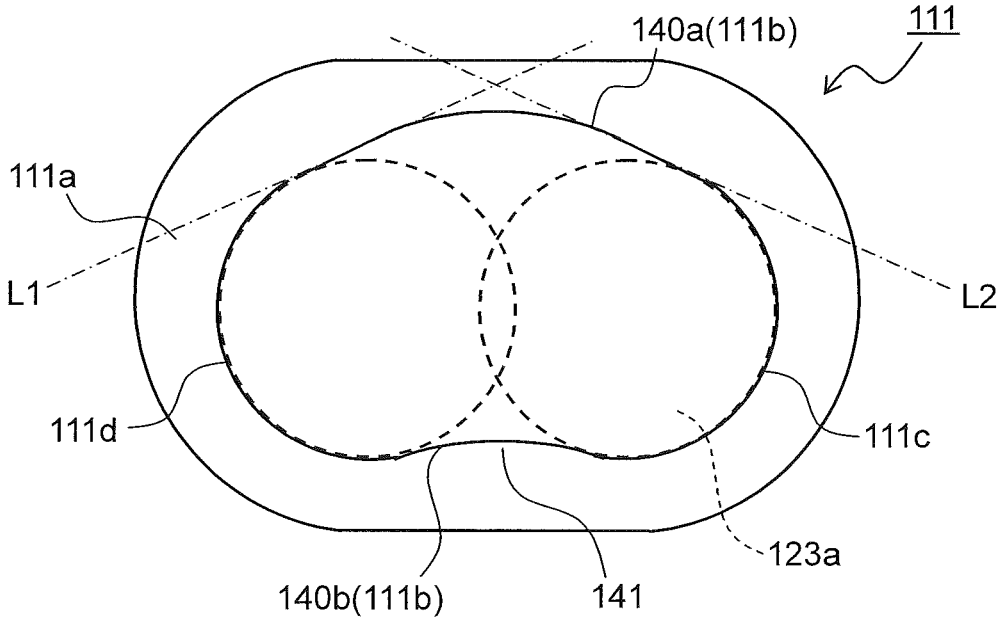
FIG. 10 is a plan view showing another shape of the slide hole of the driving device of the first embodiment.

FIG. 10 is a diagram showing another shape of the slide hole 111 of the driving device 101 of the first embodiment. In FIG. 10, the first sliding surface 140*a* of the arc hole part 111*b* has a shape along the straight lines L1 and L2 (a shape coinciding with the straight lines L1 and L2). In this way, in the same manner as the example shown in FIGS. 8 and 9, there is no possibility that the movement of the rotation shaft 123*a* in the slide hole 111 is prevented by the first sliding surface 140*a*.

Figure 11:
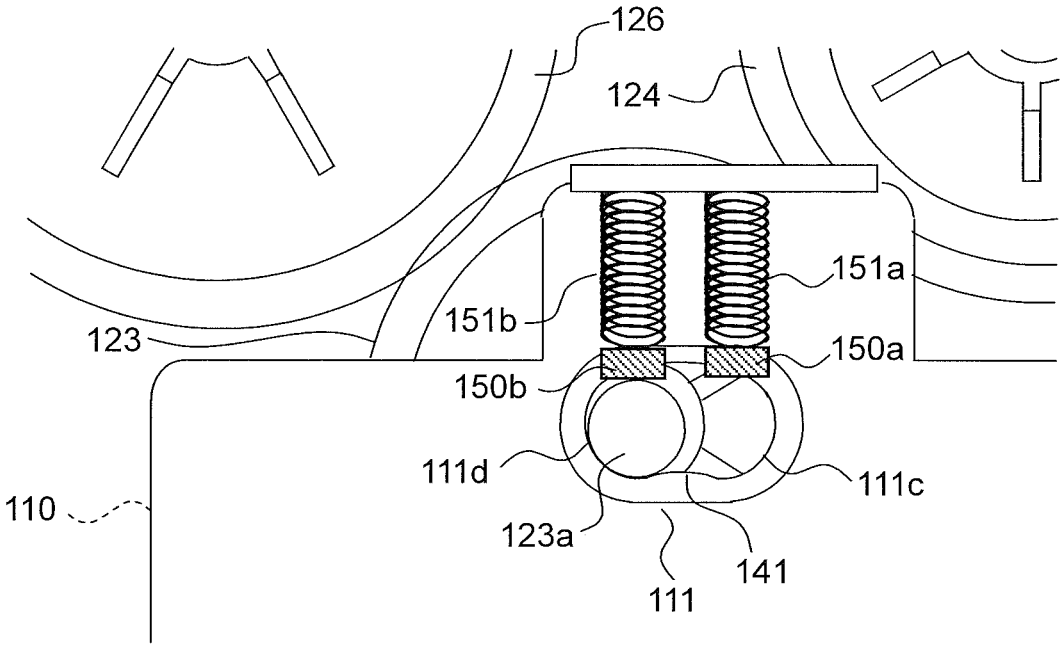
FIG. 11 is a cross-sectional side view showing a holding structure for the swing gear of the driving device according to a second embodiment of the present disclosure.

FIG. 11 is a cross-sectional side view showing a holding structure for the swing gear 123 of the driving device 101 according to a second embodiment of the present disclosure. This embodiment is provided with pressing members 150*a* and 150*b* that contact with the outer peripheral surface of the rotation shaft 123*a* of the swing gear 123 from the first sliding surface 140*a* side, and compression springs 151*a* and 151*b* that bias the pressing members 150*a* and 150*b* toward the rotation shaft 123*a*. Structures of other parts of the driving device 101 such as the shape of the slide hole 111 are the same as those in the first embodiment.

The pressing members 150*a* and 150*b* are mounted in the bracket 110 in a reciprocatable manner in the up/down direction. Each of the pressing members 150*a* and 150*b* presses the rotation shaft 123*a* from the first sliding surface 140*a* side in a state where the rotation shaft 123*a* contacts with the contact part 111*c* or 111*d*.

When the drive gear 122 (see FIG. 4) is rotated in the A direction in the state of FIG. 11 in which the rotation shaft 123*a* contacts with the contact part 111*d*, a pressing force in a pressure angle direction acts on the swing gear 123 from the drive gear 122. This pressing force pushes up the pressing member 150*b* against the biasing force of the compression spring 151*b*, and the rotation shaft 123*a* moves toward the contact part 111*c* along the arc hole part 111*b* (first sliding surface 140*a*).

After that, the rotation shaft 123*a* moves over the convex shape 141 of the second sliding surface 140*b* and enters between the pressing member 150*a* and the contact part 111*c*. The rotation shaft 123*a* is pressed from the above by the pressing member 150*a* with the biasing force of the compression spring 151*a* and hence is held in the state contacting with the contact part 111*c*. An operation opposite to the above operation is performed when the rotation shaft 123*a* moves from the contact part 111*c* to the contact part 111*d*.

According to this embodiment, the rotation shaft 123*a* is held in the state contacting with the contact part 111*d* or 111*c* by the pressing force of the pressing member 150*a* or 150*b* and the convex shape 141 of the second sliding surface 140*b*. Therefore, the swing gear 123 can be held more securely at the first position or the second position.

Other than that, the present disclosure is not limited to the embodiments described above but can be variously modified within the scope of the present disclosure without deviating from the spirit thereof. For example, the above embodiments describe the case where the driving device 101 is applied to the sheet feeding device that feeds paper sheets from the sheet feed cassettes 47 and 48, but the present disclosure is not limited to this. The driving device 101 can also be applied to an image forming unit capable of switching the color image forming apparatus between (monochrome) image formation by black color and multicolor (color) image formation.

The present disclosure can be applied to a driving device used in an image forming apparatus such as a copier, a printer, a facsimile, and a multifunction peripheral of them. By utilizing the present disclosure, it is possible to provide a driving device capable of switching rotation speed of a drive output part with a simple structure, preventing a switching error, and being usable in a wide speed range, and to provide a sheet feeding device and an image forming apparatus including the driving device.

What is claimed is:

1. A driving device comprising:

a motor for generating a rotation drive force;

a drive gear capable of rotating in a first direction and in a second direction according to forward and reverse rotations of the motor;

a swing gear that is disposed to engage with the drive gear and is capable of swinging between a first position and a second position by a rotation drive force transmitted from the drive gear;

a first gear member that engages with the swing gear when the drive gear rotates in the first direction so that the swing gear swings to the first position;

a second gear member that engages with the swing gear when the drive gear rotates in the second direction so that the swing gear swings to the second position;

a frame for holding the first gear member and the second gear member in a rotatable manner; and a bracket having a slide hole for holding a rotation shaft of the swing gear in a slidable and rotatable manner so as to guide the swing gear to the first position and to the second position, the bracket being attached to the frame, wherein the slide hole includes a pair of contact parts having an arc shape with which the rotation shaft contacts when the swing gear is positioned at the first position and at the second position, and an arc hole part for connecting the pair of contact parts with a first sliding surface farther from the drive gear and a second sliding surface nearer to the drive gear, and the first sliding surface has a shape retracting to the opposite side to the rotation shaft from tangential lines of the rotation shaft contacting with the contact parts, which are parallel to pressure angle directions between the drive gear and the swing gear, or a shape coinciding with the tangential lines.

2. The driving device according to claim 1, comprising a holding mechanism for holding the rotation shaft in a state contacting with one of the contact parts.

3. The driving device according to claim 2, wherein the holding mechanism includes a pressing member that contacts with an outer peripheral surface of the rotation shaft from the first sliding surface side, and a biasing member that biases the pressing member toward the rotation shaft.

4. The driving device according to claim 2, wherein the holding mechanism is a convex shape toward inside of the slide hole from the second sliding surface.

5. The driving device according to claim 1, wherein the second gear member has a reduction ratio different from that of the first gear member, a gear train is provided, which is engaged with the first gear member and the second gear member so as to transmit a rotation drive force of the drive gear to a drive output part, and rotation speeds of the drive output part are capable of being switched.

6. The driving device according to claim 5, comprising an idle gear for engaging with the second gear member and the gear train, wherein the gear train rotates in the same direction when the drive gear rotates in the first direction and when the drive gear rotates in the second direction.

7. A sheet feeding device comprising the driving device according to claim 1.

8. An image forming apparatus comprising the driving device according to claim 1.

* * * * *